US005535895A

United States Patent [19]

Valiulis

[11] Patent Number: 5,535,895

[45] Date of Patent: Jul. 16, 1996

[54] DISPLAY UNIT

[75] Inventor: Stanley C. Valiulis, Rockford, Ill.

[73] Assignee: Southern Imperial, Inc., Rockford, Ill.

[21] Appl. No.: 365,094

[22] Filed: Dec. 28, 1994

[51] Int. Cl.[6] ..... A47F 5/00

[52] U.S. Cl. ..... 211/59.1; 211/163

[58] Field of Search ..... 211/57.1, 59.1, 211/58, 163, 95, 115

[56] References Cited

U.S. PATENT DOCUMENTS

| | | | |
|---|---|---|---|
| 1,742,164 | 12/1929 | Berke | 211/59.1 |
| 2,071,290 | 2/1937 | Scriba | 211/58 |
| 3,788,489 | 3/1974 | Levinthal | 211/163 |
| 3,827,571 | 8/1974 | Koutny | 211/59.1 |
| 3,978,593 | 9/1976 | Pulitzer et al. | 211/59.1 X |
| 4,114,763 | 9/1978 | Hochman | 211/59.1 X |
| 4,253,576 | 3/1981 | Ford et al. | 211/59.1 X |
| 4,971,204 | 11/1990 | Alsobrook | 211/58 X |
| 5,211,295 | 5/1993 | Dunn | 211/59.1 X |

*Primary Examiner*—Robert W. Gibson, Jr.
*Attorney, Agent, or Firm*—Leydig, Voit & Mayer, Ltd.

[57] ABSTRACT

A display unit includes a rotor and a scanner ring which slip onto the upper end portion of a cylindrical pole and which are rotatably supported on the pole. The rotor supports radially extending hangers for displaying articles of merchandise. The scanner ring carries decorative or information labels such as UPC identification and pricing labels corresponding to the merchandise on the hangers. The scanner ring is located above the hangers so that the labels remain visible as merchandise is added to or removed from the hangers. Additionally, the scanner ring interlocks with the top of the rotor for rotation with the rotor so as to permit the labels to remain aligned relative to the hangers as the display unit is rotated on the pole.

10 Claims, 2 Drawing Sheets

DISPLAY UNIT

BACKGROUND OF THE INVENTION

This invention relates generally to a display unit for supporting one or more articles. More specifically, the invention relates to a display unit specially adapted to be mounted onto the upper end portion of a vertical pole for displaying articles of merchandise on the pole.

A display unit of this general type includes a rotor which carries radially outwardly extending display hangers for supporting the merchandise. The rotor is formed with a centrally located opening sized to slidably and rotatably receive the pole. The rotor slidably rests on a collar secured to the pole so that the rotor can be manually rotated on the pole to turn the merchandise on the hangers to different positions.

This general type of display unit is advantageous in that it can carry a variety of merchandise near the top of a free standing and portable pole. Alternately, the display unit may be located on a pre-existing pole without the need for additional floor space. Additionally, this type of display unit is portable in that the display unit can be relocated from one pole to another.

Identification labels such as UPC labels corresponding to the merchandise on a display unit are useful to provide information for reordering additional merchandise and for electronic scanning when taking inventory. The identification label for merchandise on a particular hanger is frequently located on a card on the hanger behind the merchandise. This location, however, is inconvenient for inventory purposes if the hanger is filled with merchandise and the label is hidden. Additionally, if pricing labels can be located adjacent the merchandise on a display unit of this type, the need to individually mark prices on the merchandise will often be eliminated.

SUMMARY OF THE INVENTION

The general aim of the present invention is to provide a new and improved rotatable display unit which is capable of carrying labels that remain visible and aligned with the merchandise to which the labels correspond.

A more detailed objective is to achieve the forgoing by providing an axially extending ring portion secured for rotation with the merchandise and located above and generally adjacent the merchandise.

Another objective of the invention is to provide means for displaying general information signs such as "sale" signs which remain aligned relative to the merchandise as the display unit is rotated.

The invention also resides in the novel and relatively simple construction of a pole topper which enables additional signs which do not rotate with the merchandise to be placed above the display unit at a selectable orientation.

These and other objects and advantages of the invention will become more apparent from the following detailed description when taken in conjunction with the accompanying drawings.

Figure 1:
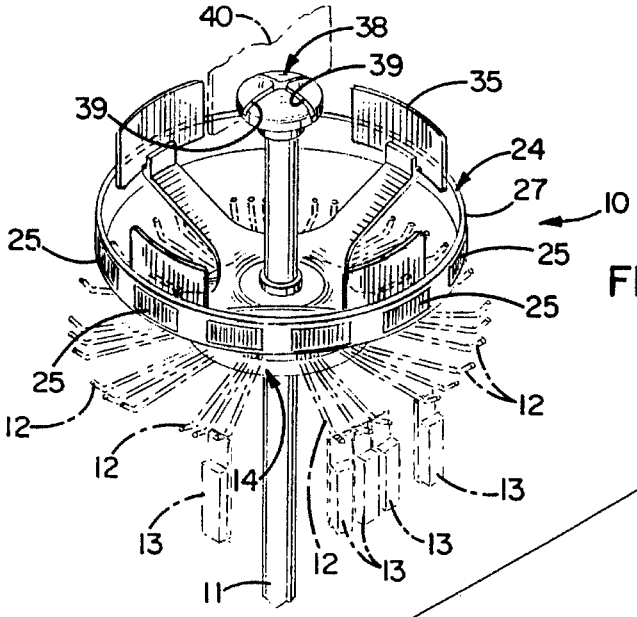
FIG. 1 is a perspective view of a new and improved rotatable display unit incorporating the unique features of the present invention and shown mounted on a pole.
Figure 6:
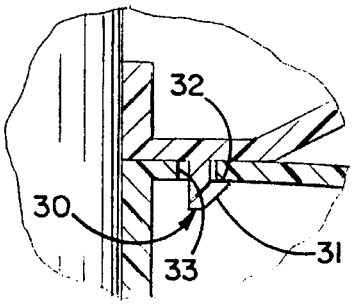
FIGS. 6 and 7 are enlarged fragmentary cross-sectional views of certain components shown in FIG. 5.
Figure 7:
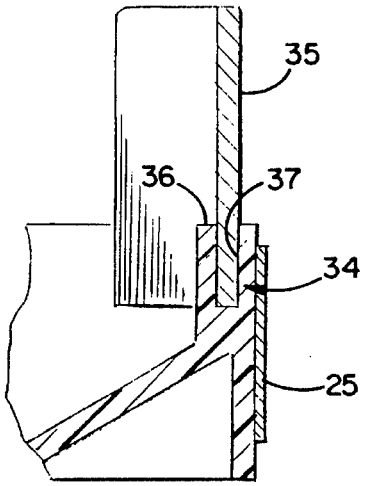
Figure 2:
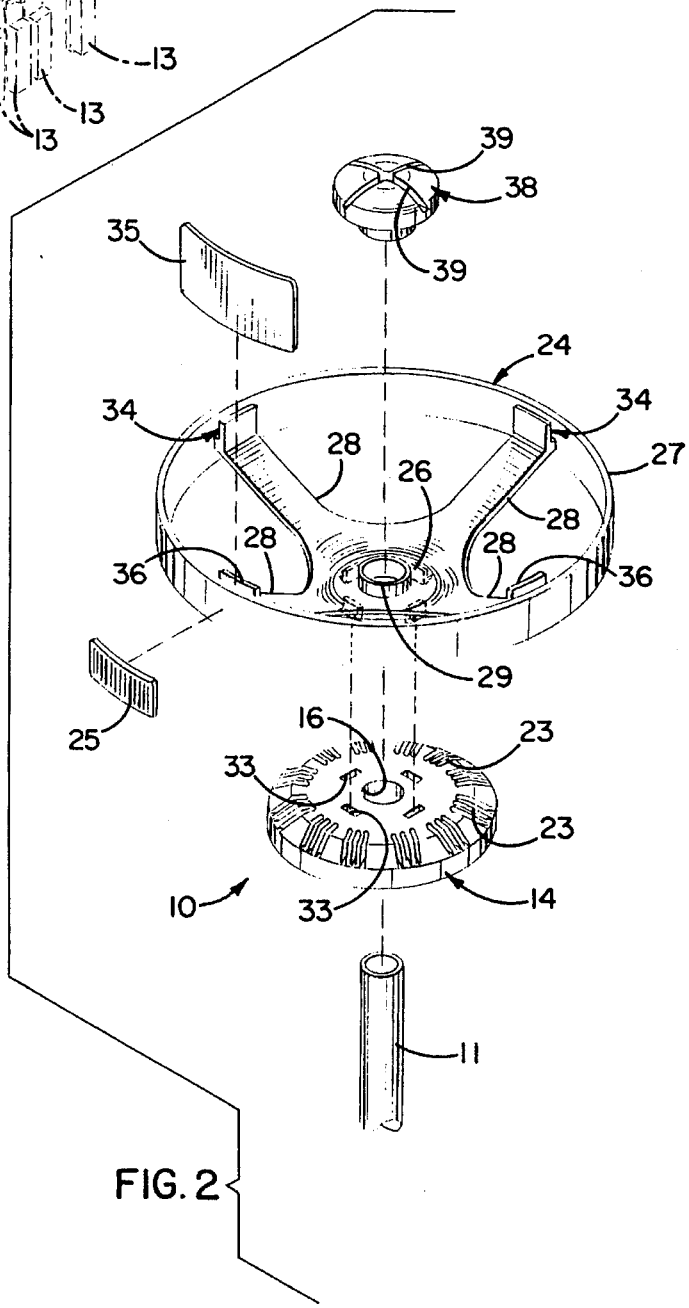
FIG. 2 is an exploded perspective view of the display unit.
Figure 3:
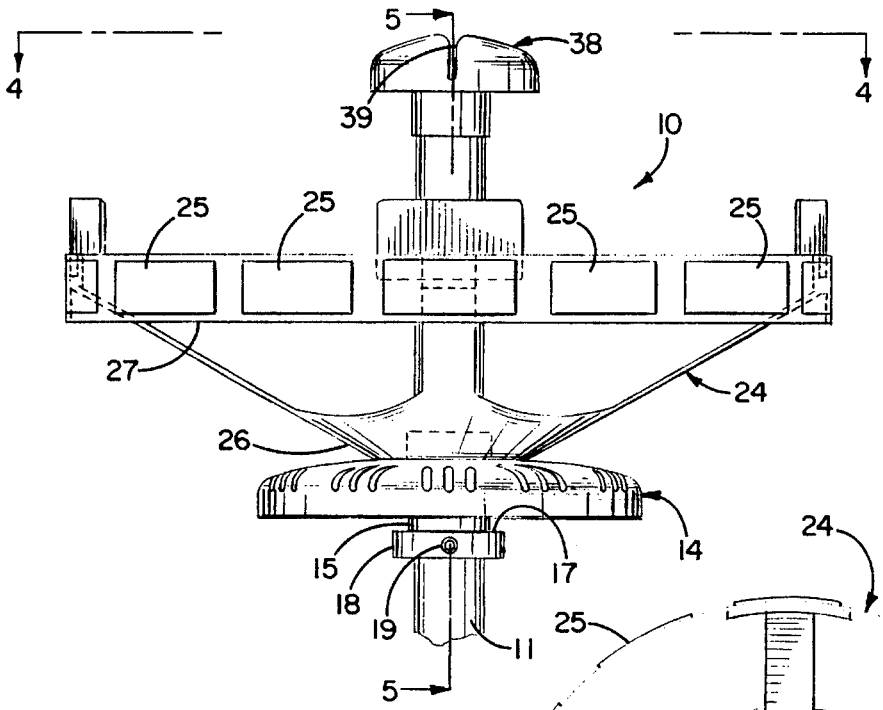
FIG. 3 is a side view of the display unit.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the present invention is shown in the drawings as embodied in a display unit 10 (FIG. 1) adapted to be slipped onto the upper end portion of a cylindrical pole 11 and adapted to carry radially extending display hangers 12 for displaying articles 13 of merchandise.

Figure 5:
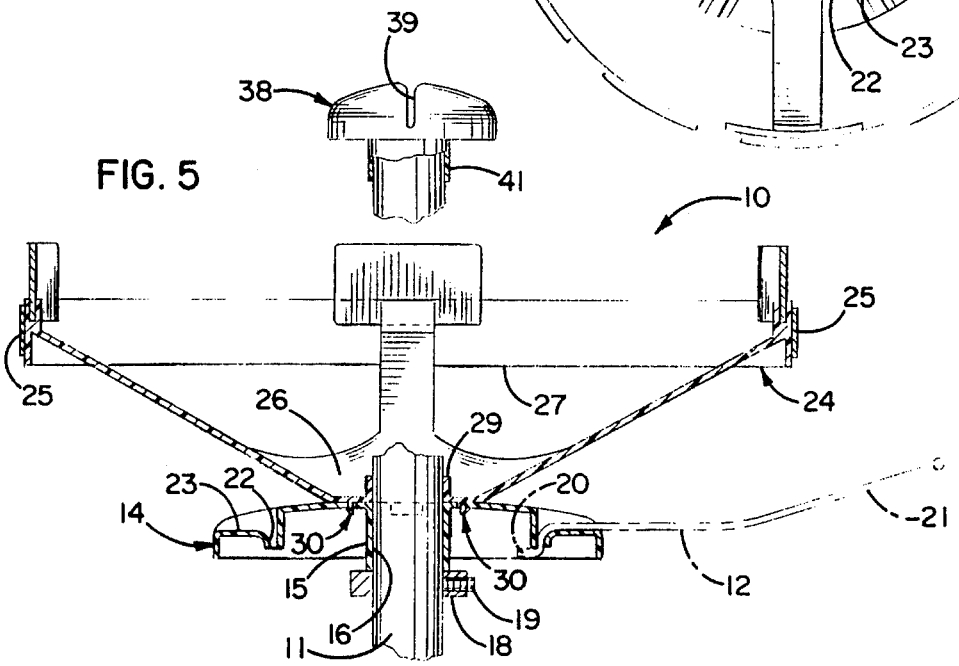
FIG. 5 is an enlarged cross-sectional view taken substantially along the line 5—5 of FIG. 3.

The display unit 10 includes a molded plastic rotor 14 (FIG. 5) having a generally inverted dish-shape and formed with a centrally located and vertically extending sleeve 15. The opening 16 in the rotor defined by the inside diameter of the sleeve is sized to slidably and rotatably receive the pole 11. The rotor is supported on the pole by a shoulder 17 defined by, for example, the upper surface of a collar 18 which has been secured to the pole by a thumb screw or set screw 19. When the rotor is slipped onto the pole, the rotor simply rests on the collar so that the shoulder slidably engages the underside of the rotor and permits rotation of the rotor with respect to the pole. Use of the collar to support the rotor enables adjustment of the rotor along the length of the pole.

The rotor 14 supports the hangers 12 and can be adapted to support hangers of various types. As illustrated, a typical display hanger includes a hook portion 20 and an elongated arm 21 to support the articles 13. Angularly spaced and downwardly extending openings 22 formed in the rotor are sized to slidably receive the hook portions of the hangers. Upwardly opening slots 23 extending radially outwardly from the openings 22 are formed in the rotor and are sized to snugly receive the arms of the hangers. With this arrangement, the hanger carries the weight of the articles on the arm by reacting this weight against the root of the slot 23 and the lower inboard edge of the opening 22.

In accordance with one aspect of the invention, the display unit 10 includes a scanner ring 24 constructed to interlock with the rotor 14 and adapted to carry decorative or information labels 25 such as UPC identification and pricing labels above and generally adjacent the hangers 12. As a result, labels may be affixed to the scanner ring in a location aligned with the merchandise 13 on the hangers and will remain visible and aligned with the merchandise as the display unit is rotated on the pole 11.

More specifically, the scanner ring 24 is molded from plastic and includes a base portion 26, a vertically extending ring portion 27 to carry the labels 25, and integrally molded struts 28 to support the ring portion. The base portion rests on the top of the rotor 14 and is formed with a centrally located and vertically extending sleeve 29 sized to slidably and rotatably receive the pole 11. The outside diameter of the base portion is substantially smaller than the outside diameter of the rotor so as to not interfere with installation and removal of the hangers 12 in the rotor. The outside surface of the ring portion is molded with a relatively smooth surface to receive, for example, labels 25 having an adhesive backing or clip-on labels (not shown).

In carrying out the invention, the struts 28 support the ring portion 27 above the hangers 12 so that the labels 25 are not obscured by the merchandise 13 on the hangers. Preferably, the ring portion is formed substantially larger in diameter than the base portion 26 so that the ring portion will be located generally over the merchandise. To this end, the integrally molded struts slope upwardly upon progressing outwardly from the base portion so as to support the ring portion above and adjacent the hangers.

Figure 4:
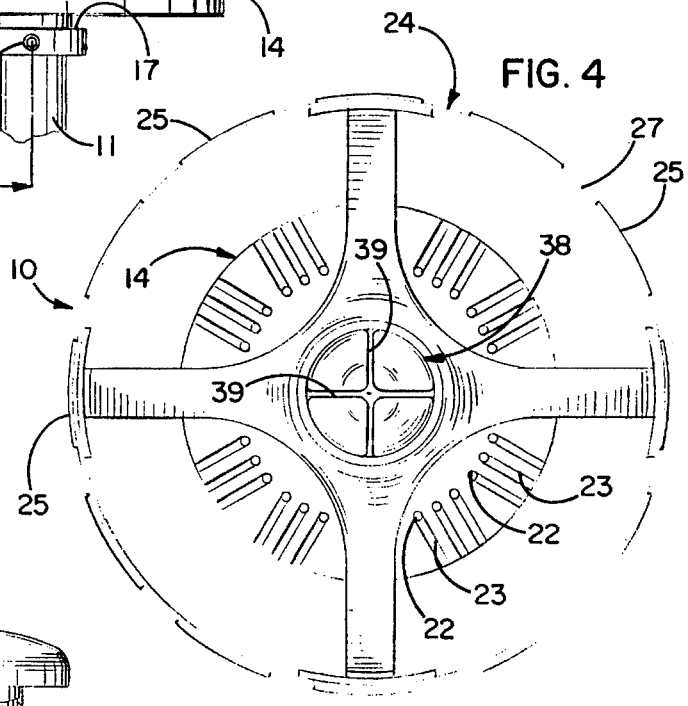
FIG. 4 is a top view as seen along the line 4—4 of FIG. 3.

In further carrying out the invention, the base portion 26 of the scanner ring 24 is formed with four angularly spaced hooks 30 (FIG. 4). The hooks extend downwardly from the base portion and are formed with a radially inwardly facing inclined cam surface 31 and a generally horizontal shoulder 32. The hooks are located and dimensioned to snap into four angularly spaced slots 23 formed in the top of the rotor.

With the foregoing arrangement, the scanner ring 24 is slipped onto the upper end portion of the pole 11 and is snapped into interlocking engagement with the rotor 14 by aligning the hooks 30 with the slots 33 and pressing downwardly to seat the scanner ring onto the rotor 14. The hooks resiliently deflect outwardly as the inclined cam surfaces 31 engage the radially inboard edges of the slots 33. When the shoulders 32 of the hooks clear the lower surface of the rotor, the hooks snap inwardly. The tip portion of the hook then engages the lower surface of the rotor to secure the scanner ring radially, axially and circumferentially relative to the rotor. As a result, the scanner ring rotates in unison with the rotor.

Advantageously, clips 34 may be integrally molded with the scanner ring 24 to carry information or advertising signs 35. In the preferred embodiment, upwardly projecting strips 36 are formed radially inwardly of the ring portion 27 to define slots 37 sized to receive the signs. In this way, the strips 36 cooperate with the ring portion to define the clips 34. Since the clips are integrally molded with the scanner ring, the signs located in these clips remain aligned relative to the hangers 12 as the display unit 10 is rotated on the pole 11.

Further in accordance with the invention, the display unit 10 includes a molded plastic pole topper 38 having at least two upwardly opening slots 39 (FIG. 4) sized to receive additional signs 40 (FIG. 1). Specifically, the pole topper is formed with a closed upper end portion and also is formed with a lower end portion which is adapted to telescope with the upper end portion of the pole. In the embodiment illustrated, the lower end portion of the pole topper is formed with a sleeve 41 (FIG. 5) sized to slidably receive the end portion of the pole 11. The two slots 39, preferably perpendicular with one another, are formed in the upper end portion of the pole topper. As a result, the additional signs 40 can be displayed above the pole at a rotationally selectable orientation and will not rotate as the merchandise 13 is rotated on the pole.

From the foregoing, it will be apparent that the present invention brings to the art a new and improved rotatable display unit 10 in which the scanner ring 24 is adapted to carry labels 25 above the merchandise 13 so that the labels remain visible as merchandise is added to or removed from the hanger 12. By virtue of integrally molded hooks 30 formed on the scanner ring and corresponding slots 33 formed in the rotor 14, the scanner ring interlocks with the rotor for rotation with the rotor. Accordingly, labels may be affixed to the scanner ring in a location aligned with merchandise on a particular hanger and the labels will remain aligned with that hanger, and thus the merchandise, as the rotor is rotated on the pole 11. Additionally, the display unit is capable of supporting signs 35 that rotate and signs 40 that do not rotate with the merchandise.

I claim:

1. A display unit adapted to carry a plurality of merchandise display hangers and a plurality of corresponding merchandise identification labels on a cylindrical pole, said display unit comprising a rotor having an opening sized to slidably and rotatably receive the pole and having means for receiving the hangers, a scanner ring having a base portion engaging the rotor and a ring portion adapted to carry the labels, the ring portion of the scanner ring having an outer periphery which is substantially greater than the periphery of the rotor, said scanner ring further having means for supporting said ring portion with respect to said base portion and generally adjacent the hangers, means for retaining said rotor and said scanner ring axially on said pole, and means for interlocking said scanner ring and said rotor for rotation in unison so as to prevent the identification labels from rotating relative to the display hangers.

2. A display unit as recited in claim 1 wherein said supporting means comprise a plurality of struts spaced outwardly of the pole.

3. A display unit as recited in claim 1 wherein said interlocking means comprise a plurality of hooks extending from said base portion and a plurality of slots formed in said rotor, said hooks being configured and dimensioned for a snap-fit into said slots.

4. A display unit as recited in claim 3 wherein said scanner ring is located above said rotor, wherein said base portion engages the upper surface of said rotor, and wherein said hooks extend downwardly from said base portion to engage said slots.

5. A display unit as recited in claim 4 wherein said retaining means comprise a collar located below said rotor and secured to the pole, said collar having a shoulder slidably engaging the underside of said rotor.

6. A display unit as recited in claim 1 further adapted to carry a plurality of signs and wherein said ring portion further includes a plurality of integrally formed clips sized to receive the signs.

7. A display unit as recited in claim 6 further comprising a pole topper telescoped with the end portion of said pole and having a closed end with at least two slots, each slot being sized to receive a sign.

8. A display unit as recited in claim 7 wherein said slots are mutually perpendicular with one another.

9. A display unit adapted to carry a plurality of outwardly extending display hangers for supporting one or more articles on a cylindrical pole, said display unit being further adapted to carry a plurality of identification labels corresponding to the articles and to carry a plurality of signs, said display unit comprising a plastic rotor having a center opening and a plurality of slots and having means for supporting the hangers, said center opening being sized to slidably and rotatably receive the pole, means for rotatably supporting said rotor on the pole, and a plastic scanner ring having a base portion and a ring portion adapted to carry the labels and having a plurality of integrally formed struts for supporting said ring portion above said hangers such that the labels remain visible when the merchandise is on the hangers, said ring portion being formed with integrally molded clips having slots sized to receive the signs, said base portion having integrally formed and downwardly extending hooks, said hooks being configured and dimensioned to snap into said slots for rotation of said scanner ring in unison with said rotor so as to prevent the labels and the signs from rotating with respect to said hangers.

10. A display unit as defined in claim 9 further comprising a pole topper telescoped with said pole and having a closed end with at least two slots, each slot being sized to receive a sign.

* * * * *